United States Patent [19]

Wachtel

[11] Patent Number: 5,050,998

[45] Date of Patent: Sep. 24, 1991

[54] DUAL LAUNDRY BAG

[76] Inventor: Boaz Wachtel, 360 E. 50th St., New York, N.Y. 10022

[21] Appl. No.: 553,547

[22] Filed: Jul. 16, 1990

[51] Int. Cl.[5] ..... B65D 30/22

[52] U.S. Cl. ..... 383/6; 383/9; 383/38; 383/40; 383/41; 383/67; 224/209; 150/117

[58] Field of Search ..... 383/9, 38, 39, 40, 41, 383/67, 80, 81, 97, 121, 72, 75, 6; 224/209, 214; 190/111; 150/117

[56] References Cited

U.S. PATENT DOCUMENTS

| | | | |
|---|---|---|---|
| 1,454,779 | 5/1923 | Wells et al. | 224/209 |
| 2,080,252 | 5/1937 | Cook | 383/72 X |
| 2,437,149 | 3/1948 | Baxter | 383/75 X |
| 2,438,860 | 3/1948 | Miller | 224/209 |
| 2,720,902 | 10/1955 | Johnson | 383/41 X |
| 2,740,445 | 4/1956 | Fornell | 383/41 X |
| 4,090,542 | 5/1978 | Hacker | 383/67 X |
| 4,094,351 | 6/1978 | Catenaccio | 383/38 X |

FOREIGN PATENT DOCUMENTS

| | | | |
|---|---|---|---|
| 26352 | 12/1953 | Finland | 224/209 |
| 1156412 | 5/1958 | France | 150/117 |
| 194618 | 3/1938 | Switzerland | 224/209 |
| 4917 | of 1878 | United Kingdom | 224/209 |

*Primary Examiner*—Stephen Marcus
*Assistant Examiner*—Jes F. Pascua
*Attorney, Agent, or Firm*—Bernard Malina

[57] ABSTRACT

A dual laundry bag has a front panel, a rear panel and a center panel which divides the dual laundry bag into two or more compartments. The top of the dual laundry bag includes a drawstring closure and a pair of grommets. The bottom of each compartment includes a zipper closure which facilitates discharging each compartment individually. The rear panel includes a pair of adjustable carrying straps and the front panel includes a flap and an adjustable belt for attachment of clothing which has been hung on hangers to the dual laundry bag.

19 Claims, 3 Drawing Sheets

DUAL LAUNDRY BAG

BACKGROUND OF THE INVENTION

Persons who do not have clothes washing machines in their own homes typically utilize laundry bags to transport their laundry to washing machines which may be centrally located in their dwelling complex or remotely located in a commercial laundromat. Even those persons having clothes washers in their homes may use laundry bags for accumulating laundry and transporting it to the washing machines.

Laundry bags typically consist of a simple cloth bag with a drawstring closure. The basic form of these bags has not been changed over time and as a result a user is faced with a number of difficulties and inconveniences while carrying a full load of laundry to the nearest washing machine or to the nearest laundromat.

The user has the problem of carrying a relatively heavy and bulky load which cannot be grasped or held conveniently. Once at the laundromat the user has to empty the entire contents of the laundry bag in order to separate the white laundry from the colored laundry. This is both awkward and time consuming since there may not be any tables or other flat surfaces available to facilitate this procedure.

OBJECTS OF THE INVENTION

It is an object of the present invention to provide a dual laundry bag which is capable of storing white and colored laundry in separate compartments and selectively discharging each compartment.

Another object of the present invention is to provide a dual laundry bag which has pockets for the storage of various items such as laundry soaps and detergents, personal radios and the like.

Another object of the present invention is to provide a dual laundry bag which includes a pair of shoulder straps.

Another object of the present invention is to provide a dual laundry bag which incorporates zipper closures.

Another object of the present invention is to provide a dual laundry bag which incorporates provisions for hanging the laundry bag during use.

Another object of the present invention is to provide a dual laundry bag which incorporates provisions for carrying clothing which has been hung on clothes hangers.

Still another object of the present invention is to provide an improved laundry bag which comprises a relatively small number of simple component parts which can be manufactured in an economical manner.

SUMMARY OF THE INVENTION

In accordance with the present invention, there is provided a dual laundry bag which includes a front panel, a rear panel and a center panel which divides the dual laundry bag into two or more compartments. The bottom of each compartment includes a zipper closure which facilitates discharging each compartment individually. The rear panel includes a pair of carrying straps and the front panel includes a flap and an adjustable belt for attachment of clothing, which has been hung on clothes hangers, to outside of the dual laundry bag.

BRIEF DESCRIPTION OF THE DRAWINGS

Additional objects and a further understanding of the invention may be had by referring to the following specification and drawings in which.

BRIEF DESCRIPTION OF THE INVENTION

Figure 1:
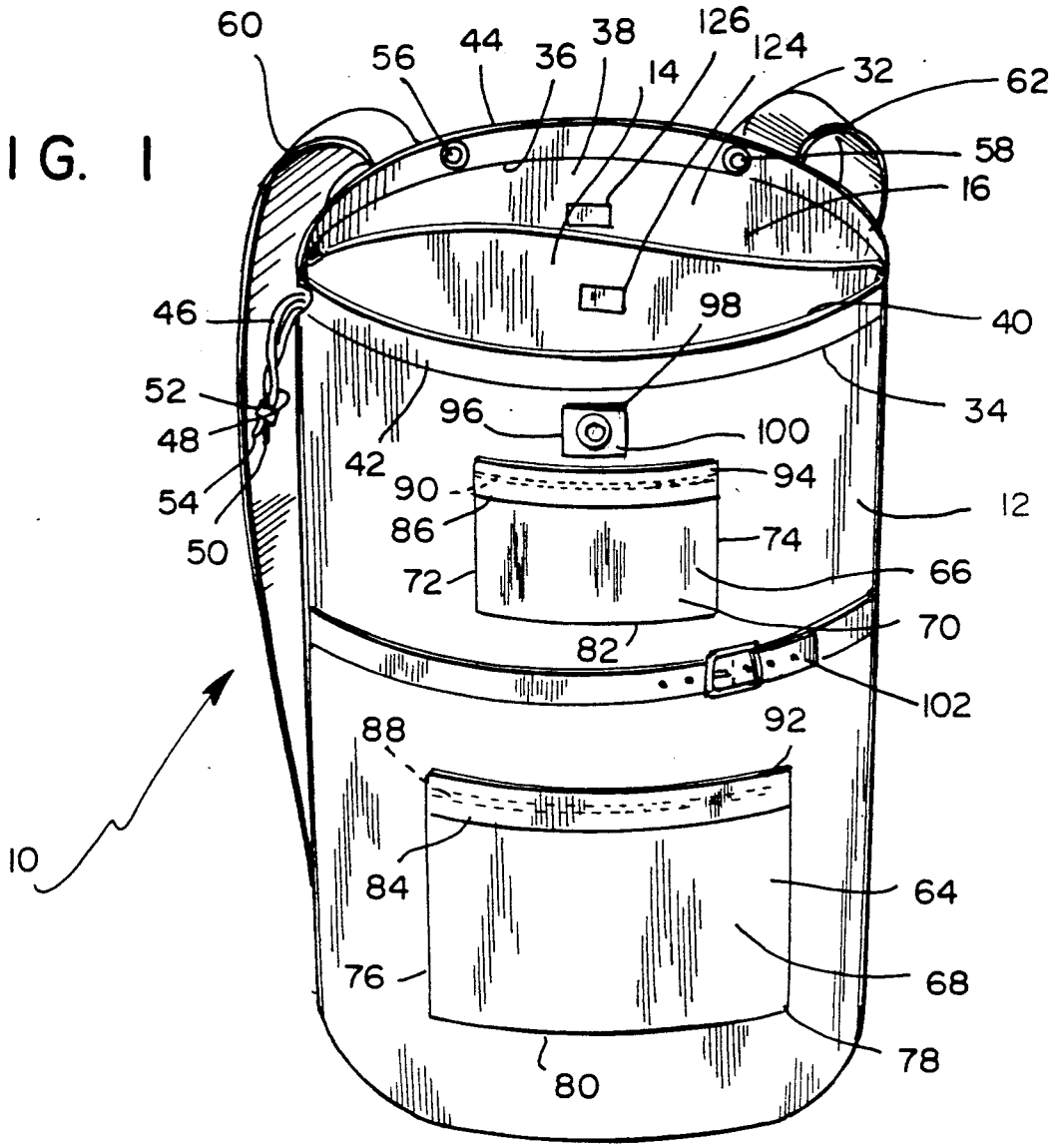
FIG. 1 is an overall perspective view of a dual laundry bag made in accordance with the present invention.
Figure 2:
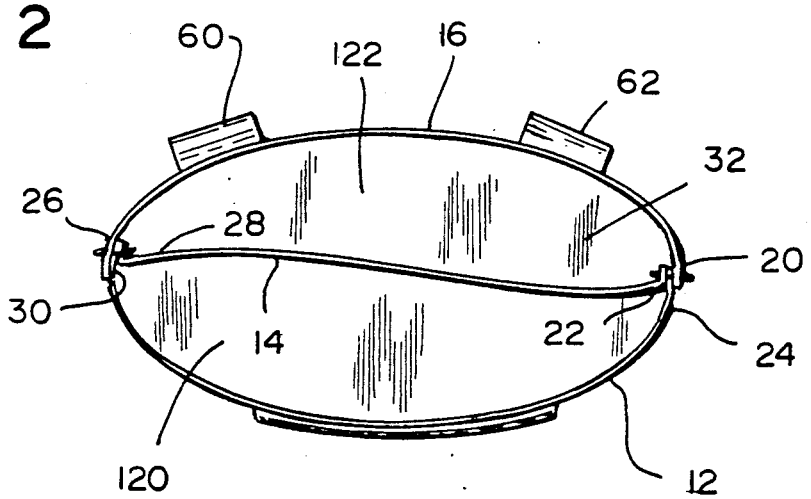
FIG. 2 is a top plan view of the dual laundry bag of FIG. 1.
Figure 3:
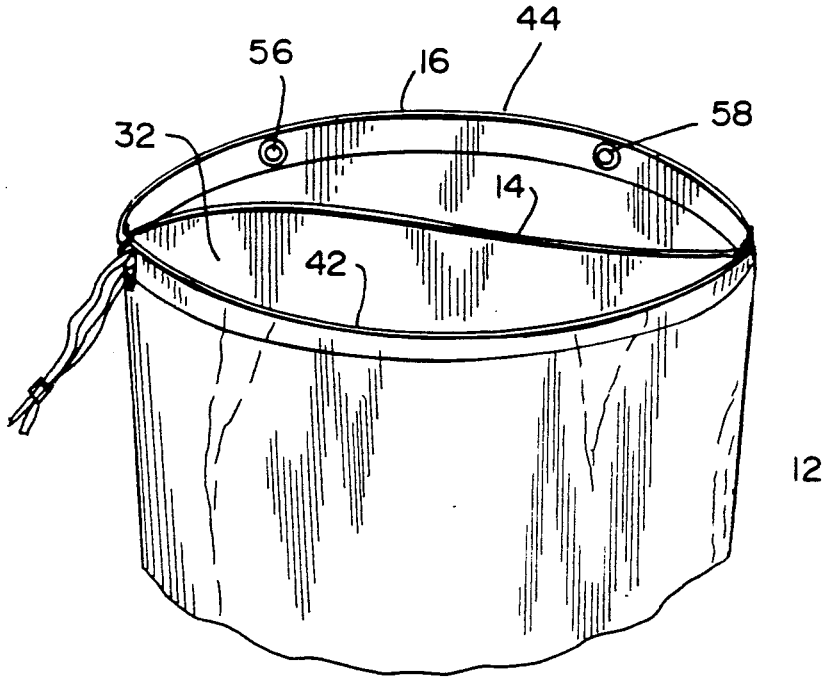
FIG. 3 is a fragmentary perspective view of the top portion of the dual laundry bag of FIG. 1.
Figure 4:
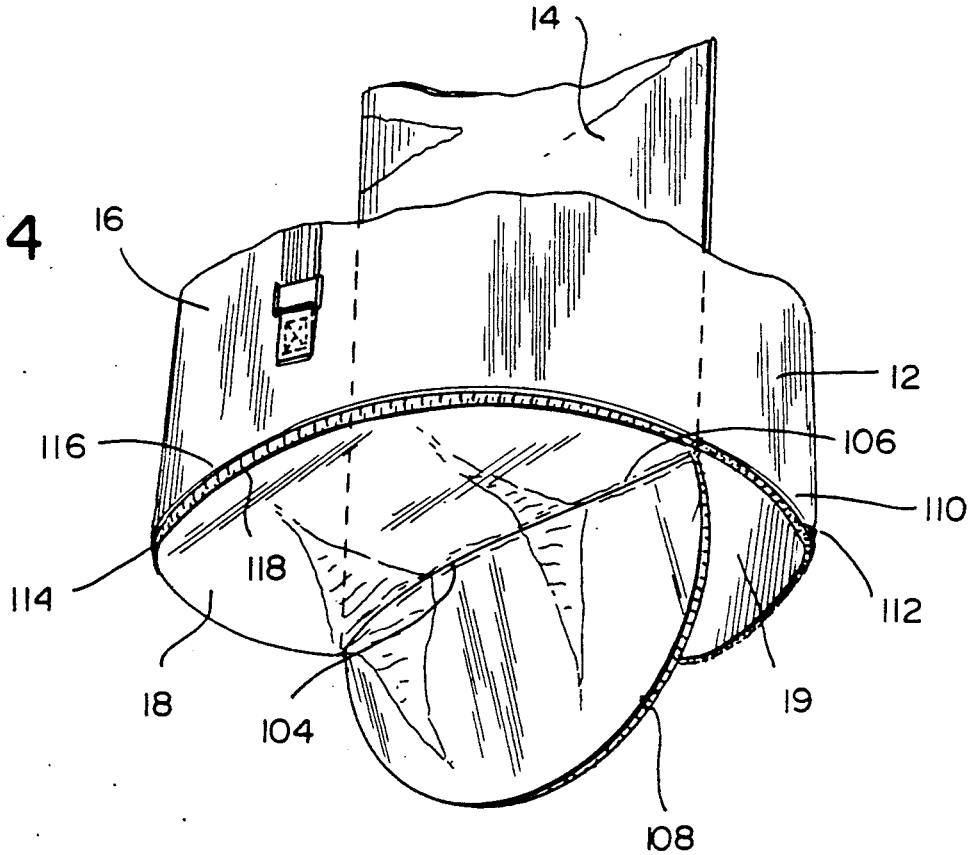
FIG. 4 is a fragmentary perspective view of the bottom portion of the dual laundry bag of FIG. 1.
Figure 5:
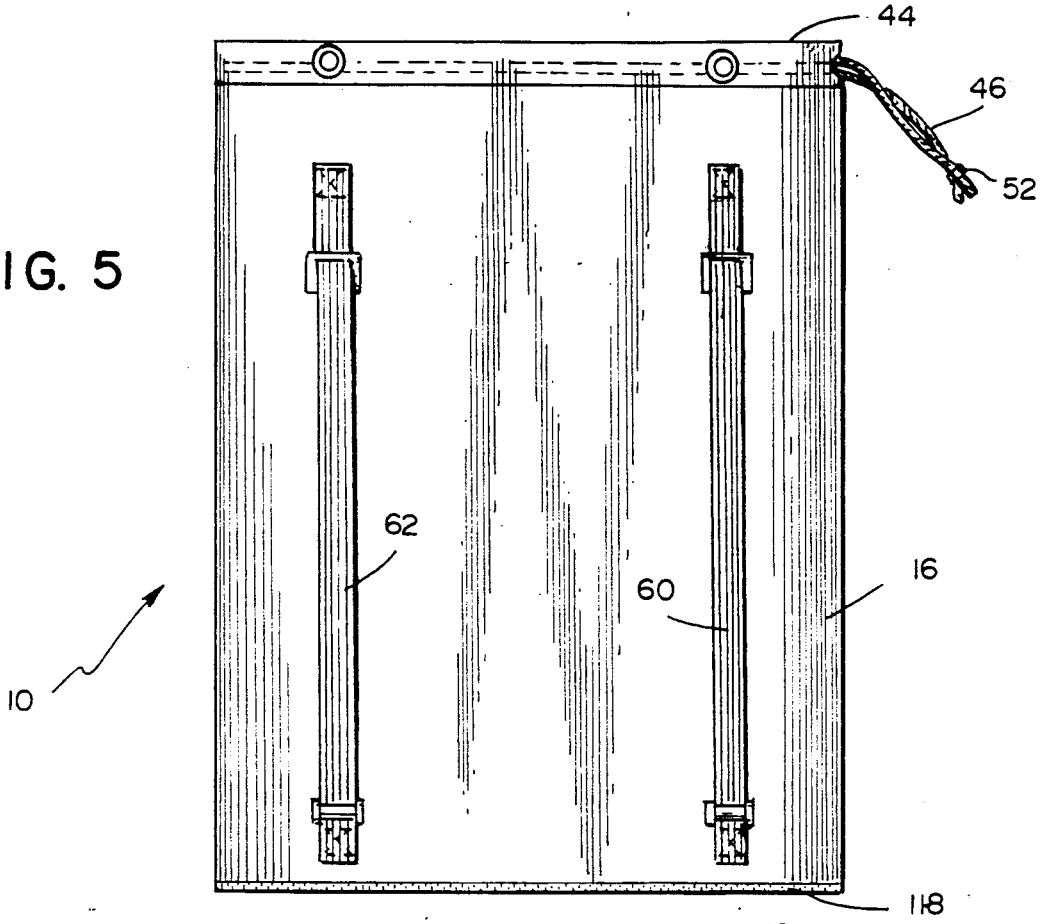
FIG. 5 is a rear elevation view of the dual laundry bag of FIG. 1.
Figure 6:
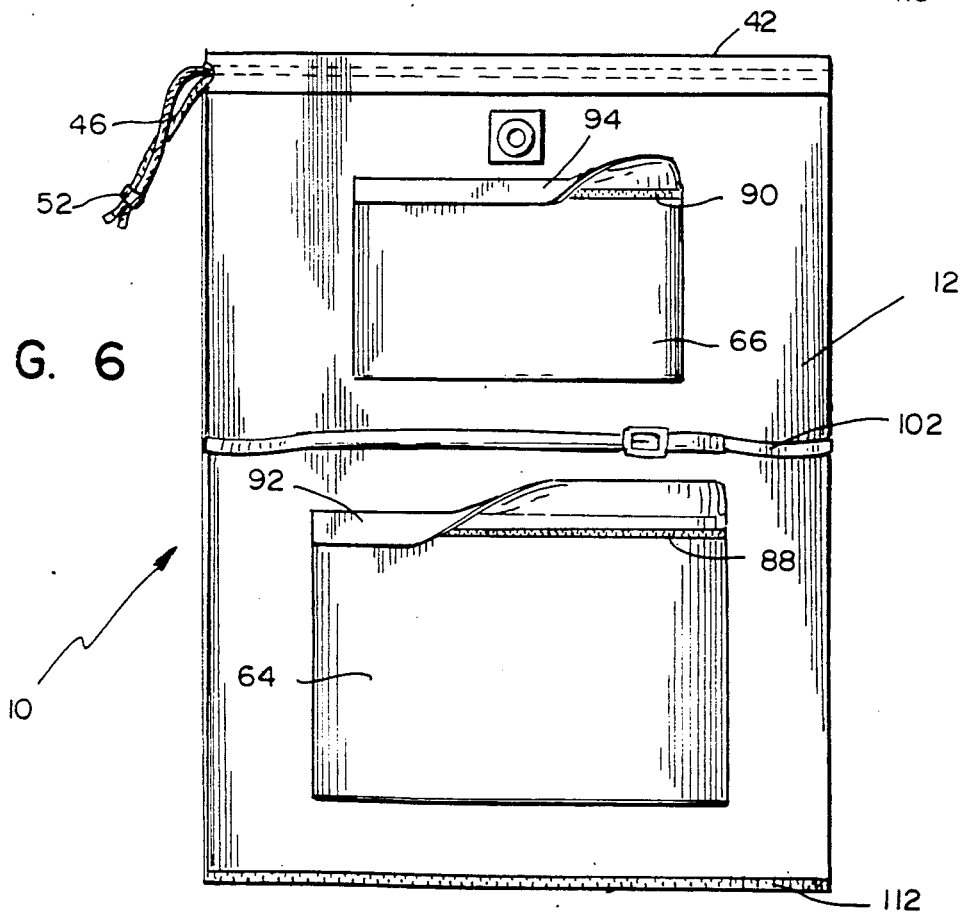
FIG. 6 is a front elevation view of the dual laundry bag of FIG. 1.

With reference to the drawings there is shown in FIG. 1 a dual laundry bag 10 made in accordance with the present invention which includes: a front panel 12, a center panel 14, a rear panel 16, and bottom panels 18, 19.

The front 12, center 14 and rear 16 panels are generally rectangular and are sewn together along their side edges 20, 22, 24, 26, 28, 30 leaving an open top 32. The top edges 34, 36 of the front and rear panels 12, 16 are folded over and sewn to the face 38, 40 of the respective panels 12, 16 to form hems 42, 44 and a drawstring 46 or cord is threaded through the hems 42, 44. Center panel 14 may be releasably secured to panels 12 and 16 such as by means of zippers, snaps or Velcro strips to allow panel 14 to be removed to convert the bag 10 to a conventional carrying bag. The ends 48, 50 of the drawstring are threaded through a slide bar 52 and are tied together to form a knot 54.

The hem 44 on the next panel 16 includes a pair of spaced apart grommets 56, 58 which may be used to hang the dual laundry bag 10 when storing laundry. The rear panel 16 also includes a pair of spaced apart carrying straps 60, 62 which enable a user to easily carry the dual laundry bag 10 on his back in the manner of a knapsack.

The front panel 12 has a larger pocket 64 and a smaller pocket 66 formed by panels 68 and 70. The panels 68 and 70 are stitched to the front panel 12 along their side 72, 74, 76, 78 and bottom edges 80, 82, leaving the top edges 84, 86 open. The top edges 84, 86 each have a zipper 88, 90 mounted thereon. The zippers 88, 90 are covered by zipper cover panels 92, 94 which are stitched to the front panel 12. The front panel 12 also includes a flap member 96 which is positioned above the smaller pocket 66 and is centrally located on the front panel 12. The flap member 96 has an upper edge 98 stitched to the front panel 12. The flap member 96 includes a grommet 100 which facilitates hanging a clothes hanger or a hook on the laundry bag 10. The flap member 96 may also be used to carry washed clothing such as wash and wear clothing which has been hung on hangers or clothes which have been dry cleaned and hung on hangers. The front panel 12 also includes an adjustable horizontal belt 102 which may be used to restrain the lower portions of clothing which have been hung from the flap 96.

The center portion 104 of the bottom panel 18 is stitched to the lower edge 106 of the center panel 14. The edge 108 of the bottom panel 18 is connected to the lower edge 110 of the front panel 12 by means of a zipper 112 and the edge 114 of the bottom panel 18 is connected to the lower edge 116 of the rear panel 16 by means of a zipper 118.

The bottom panel 18 may be rectangular, circular, oval or any shape between rectangular or circular.

During use, the zippers 110, 118 are closed, the drawstring 46 is opened and the dual laundry bag 10 may be hung from the grommets 56, 58. Alternatively, the dual laundry bag 10 may be hung from the grommet 100 or placed on the floor with the hems 42, 44 facing upward. Laundry may be placed in the compartment 120 formed by front panel 12 and the center panel 14 and the compartment 122 formed by the rear panel 16 and the center panel 14 in a convenient manner. The dual compartments 120, 122 enables a user to sort the laundry in order to separate white from colored laundry or in any other manner desired.

When the dual laundry bag 10 has been filled the draw cord 46 is pulled closed.

The dual laundry bag 10 can be easily carried on the user's back using the two carrying straps, leaving the user's hands free.

The pockets 62, 64 may be used to carry various items such as soap, detergent, bleach or other items such as reading material, personal radios and the like. These pockets prevent the accidental spilling of these washing products from damaging the laundry carried in the dual laundry bag.

Once at the laundry, the clothing in the compartments 120, 122 can be discharged individually into separate washing machines. Since the laundry had been sorted previously, the need to spread out the laundry for sorting has been eliminated. This results in saving of both time and effort.

The front 12, rear 16, center 14 and bottom panels 18, as well as the panels 68, 70 which form the pockets, may be made of one of a number of types of fabric or flexible plastic film materials.

It is understood that within the scope of the present invention the laundry bag 10 may include more than two compartments to provide greater versatility. Thus, laundry may be divided into additional categories which require separate washing such as delicate fabrics which may in turn be subdivided into white and colored items.

In order to avoid confusion, the various laundry compartments may be identified by appropriate indicia such as labels 124, 126 affixed near the top of panels 14, 16, and also to the bottom panels 108, 109.

While a preferred embodiment of the invention has been shown and described herein, it is obvious that numerous changes and omissions may be made in such embodiment without departing from the spirit and scope of the invention.

What is claimed is:

1. A dual laundry bag comprising a front panel, with said front panel comprising top, bottom and side edges, a rear panel with said rear panel comprising top, bottom and side edges, a center panel with said center panel comprising top, bottom and side edges, a bottom panel with said bottom panel comprising a first portion, a second portion and a center portion, first connection means connecting said side edges of said front panel to said side edges of said center panel and connecting said bottom edge of said center panel to said center portion of said bottom panel thereby forming a first compartment and connecting said side edges of said rear panel to said side edges of said center panel, thereby forming a second compartment, first closure means releasably connecting said first portion of said bottom panel and said bottom edge of said front panel, second closure means releasably connecting said second portion of said bottom panel and said bottom edge of said rear panel.

2. A dual laundry bag according to claim 1 further comprising third closure means releasably connecting said top edges of said front and said rear panels.

3. A dual laundry bag according to claim 2 in which said third closure means comprises a drawstring.

4. A dual laundry bag according to claim 1 in which said first closure means comprises a zipper.

5. A dual laundry bag according to claim 1 in which said second closure means comprises a zipper.

6. A dual laundry bag according to claim 1 in which said rear panel further comprises a pair of carrying straps.

7. A dual laundry bag according to claim 6 in which said carrying straps are adjustable.

8. A dual laundry bag according to claim 1 in which said top edge of said rear panel further comprises a pair of grommets.

9. A dual laundry bag according to claim 1 in which said front panel further comprises a flap member and with said flap member including a grommet.

10. A dual laundry bag according to claim 1 in which said front panel further includes an adjustable belt.

11. A dual laundry bag according to claim 1 in which said front panel further comprises a pocket panel and attachment means attaching said pocket panel to said front panel to form a pocket.

12. A dual laundry bag according to claim 1 in which said pocket panel comprises closure means to releasably close said pocket.

13. A dual laundry bag according to claim 1 in which said front, rear, center and bottom panels are made of fabric.

14. A dual laundry bag according to claim 1 in which said front, rear, center and bottom panels are made of flexible plastic film.

15. A dual laundry bag according to claim 1 in which said front, rear and center panels are rectangular.

16. A dual laundry bag according to claim 1 in which said bottom panel is rectangular.

17. A dual laundry bag according to claim 1 in which said bottom panel is circular.

18. A dual laundry bag according to claim 1 in which said bottom panel is oval.

19. A dual laundry bag according to claim 1 in which said bottom panel is of a shape between circular and rectangular.

* * * * *